US008824702B2

(12) United States Patent
Yu

(10) Patent No.: US 8,824,702 B2
(45) Date of Patent: Sep. 2, 2014

(54) REVERSE-PHASE MODULATING STRUCTURE OF PIEZOELECTRIC CERAMIC SPEAKER

(75) Inventor: Hsiang-Chih Yu, New Taipei (TW)

(73) Assignee: Abatech Electronics Co., Ltd., Taipei (TW)

( * ) Notice: Subject to any disclaimer, the term of this patent is extended or adjusted under 35 U.S.C. 154(b) by 130 days.

(21) Appl. No.: 13/589,186

(22) Filed: Aug. 20, 2012

(65) Prior Publication Data

US 2014/0050339 A1 Feb. 20, 2014

(51) Int. Cl.
*H04R 3/00* (2006.01)

(52) U.S. Cl.
USPC ..... 381/114; 381/173; 381/190

(58) Field of Classification Search
USPC ..... 381/114, 173, 190
See application file for complete search history.

(56) References Cited

U.S. PATENT DOCUMENTS 4,373,119 A * 2/1983 Feder ..... 381/190
2010/0158283 A1* 6/2010 Kim et al. ..... 381/190

* cited by examiner

*Primary Examiner* — Davetta W Goins
*Assistant Examiner* — Amir Etesam
(74) *Attorney, Agent, or Firm* — Leong C. Lei

(57) ABSTRACT

The present invention provides a reverse-phase modulating structure of a piezoelectric ceramic speaker, comprising a positioning frame, an acoustic generator and two or more than two flexible units; wherein the acoustic generator comprises a plurality of ceramic layers stacked onto one another to form a ceramic slat, and said flexible units are clamped between an inner edge of the positioning frame and the acoustic generator. Via the pressure exerted onto the acoustic member by the flexible units, the in-phase movement of the acoustic generator can be modulated and the phase conflict of the acoustic generator can be reduced as well as the prevision of the sound quality distortions such that high quality of the ceramic speaker can be enhanced and realized.

8 Claims, 4 Drawing Sheets

REVERSE-PHASE MODULATING STRUCTURE OF PIEZOELECTRIC CERAMIC SPEAKER

TECHNICAL FIELD OF THE INVENTION

The present invention is related to a reverse-phase modulating structure of a piezoelectric ceramic speaker, in particular, to a flexible unit configured to modulate the pressure of an acoustic generator to achieve the modulation of the in-phase movements of the acoustic generator and in order to reduce the phase conflicts of the ceramic speaker and to prevent distortions of the sound quality such that a piezoelectric ceramic speaker structure having an enhanced effect of high quality of sound can be realized.

DESCRIPTION OF THE PRIOR ART

As the technology improves rather rapidly over time, the commonly known 3C electronic devices including such as iPad, iPhone or mobile phone, laptop computers are being widely used or adapted in various applications. On the other hand, the internal speakers and audio circuitry utilized by such electronic devices are required to be of greater quality with relatively smaller sizes. Therefore, presently, the use of thin-type piezoelectric ceramic speakers in electronic devices is being developed. Nevertheless, during the operation of the ceramic speakers, the shockwaves stretching back and forth are likely to cause phase conflicts with the in-phase movements generated by the ceramic speakers, and as a result, distortions to the sound quality of the ceramic speakers would occur, which is ought to be improved. With regard to such problems associated with ceramic speakers, the inventor seeks to improve and enhance the effects of high quality of sound of ceramic speakers with years of experience in research and development of audio related products and equipment.

SUMMARY OF THE INVENTION

A primary objective of the present invention is to provide a reverse-phase modulating structure of a piezoelectric ceramic speaker. Via pressure adjustments on or directed to the ceramic acoustic generator by the flexible unit, the in-phase movement of the ceramic acoustic generator is modulated in order to reduce the phase conflict of said ceramic speaker, to prevent sound quality distortion and such that high quality of sound of said ceramic speaker can be enhanced and realized.

The abovementioned reverse-phase modulating structure of a piezoelectric ceramic speaker comprises a positioning frame, an acoustic generator and two or more than two flexible units; wherein said acoustic generator comprises a plurality of ceramic layers stacked onto one another to form a ceramic slat, and said plurality of flexible units are clamped between an inner edge of said positioning frame and said acoustic generator. Via the pressure exerted on said acoustic generator by said flexible units, the in-phase movement of said acoustic generator is modulated in order to reduce the phase conflict of said ceramic speaker and to prevent sound quality distortion such that high quality of sound of said ceramic speaker is enhanced and realized.

According to the abovementioned reverse-phase modulating structure of a piezoelectric ceramic speaker, wherein said flexible units clamped between said positioning frame and said acoustic generator can be a silicon board, sponge or pressure spring.

According to the abovementioned reverse-phase modulating structure of a piezoelectric ceramic speaker, wherein a threaded holes are provided at a central position of the positioning frame, and a rotating member is fastened into said threaded hole to clamp said flexible unit between a bottom of said rotating member and said acoustic generator, and such that by moving said rotating member in an upward or an downward movement along said threaded hole, said acoustic generator is compressed or released correspondingly via said flexible unit to achieve pressure adjustments on said acoustic generator.

DETAILED DESCRIPTION OF THE PREFERRED EMBODIMENTS

Figure 1:
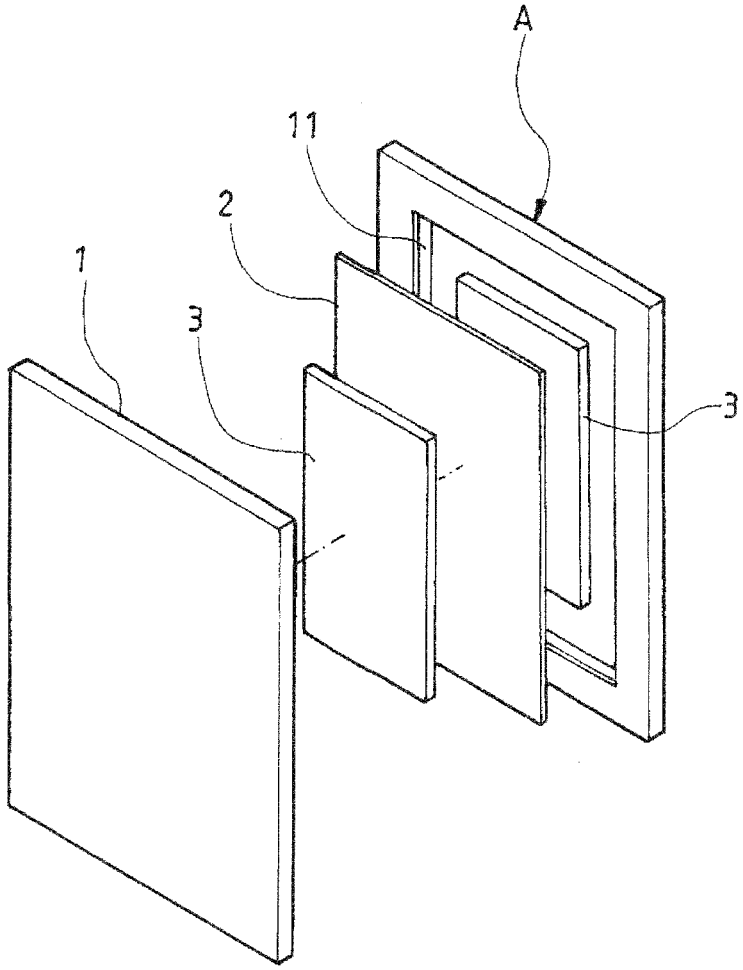
FIG. 1 is an exploded perspective view of the present invention.
Figure 2:
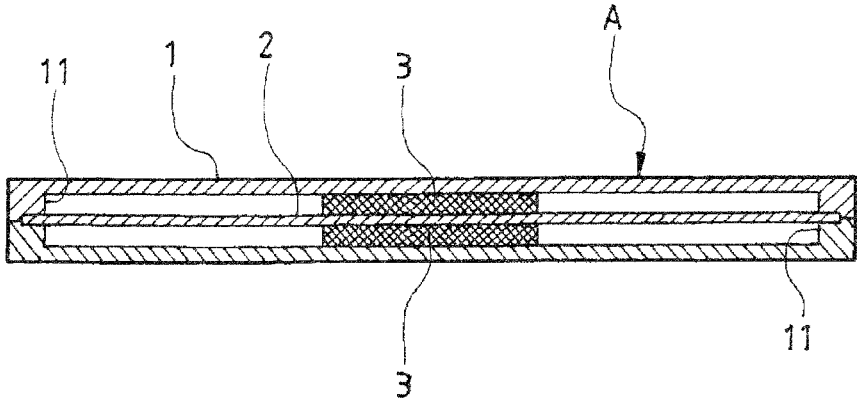
FIG. 2 is a sectional view of the present invention.

FIGS. 1 and 2 show an exploded perspective view and a sectional view of the present invention respectively. As shown in the figures, the present invention comprises a positioning frame 1, an acoustic generator 2 and two or more than two flexible units 3; wherein, in this embodiment, an inner edge of the positioning frame 1 is surrounded by a stepped portion 11, and the acoustic generator 2 comprises of a plurality of ceramic layers stacked onto one another to form a ceramic slat or is formed by attaching the ceramic slat to a sound board. Lead wires (not shown) are soldered onto the acoustic generator as a means for providing sound signals from a sound source and are clamped firmly at the stepped portion 11 in the positioning frame 1. The ceramic speaker A is therefore formed and constructed.

The flexible unit 3 is clamped between the inner edge of the positioning frame 1 and the acoustic member 3. In this embodiment, the flexible unit 3 is a silicon board.

According to the abovementioned structural combination, the reverse-phase modulating structure of the piezoelectric ceramic speaker is constructed. Via the compression exerted onto the acoustic generator 2 by the flexible unit 3, the acoustic generator 2 is subject to a pressure such that the in-phase movement of the acoustic generator 2 is modulated or suppressed in order to reduce the phase conflicts of the acoustic generator 2 and to prevent sound quality distortion such that the high quality of sound of the ceramic speaker A can be enhanced or realized.

Figure 3:
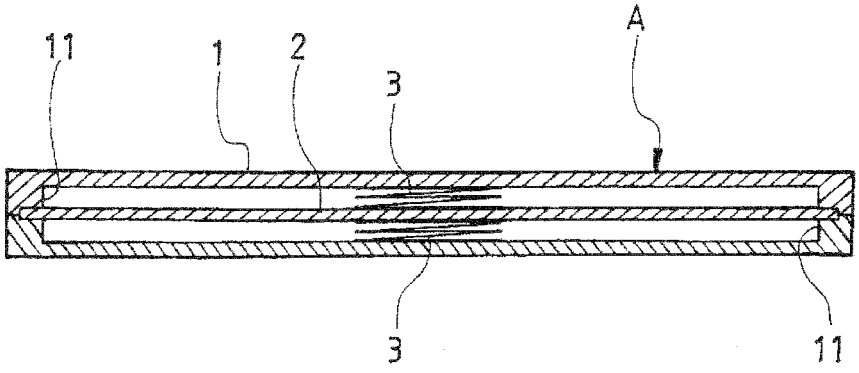
FIG. 3 is a sectional view of a second embodiment of the flexible unit of the present invention.

FIG. 3 shows a sectional view of a second embodiment of the flexible unit of the present invention. As shown in the figure, the flexible unit 3 of the present invention can be a pressure spring, clamped between the inner edge of the positioning frame 1 and the acoustic generator 3, and provided to exert a pressure onto the acoustic generator 2 in order to modulate or suppress the in-phase movement of the acoustic generator 2 and to reduce the phase conflict of the acoustic generator 2 as well as to prevent sound quality distortions such that the high quality of sound of the ceramic speaker A can be enhanced or realized.

Figure 4:
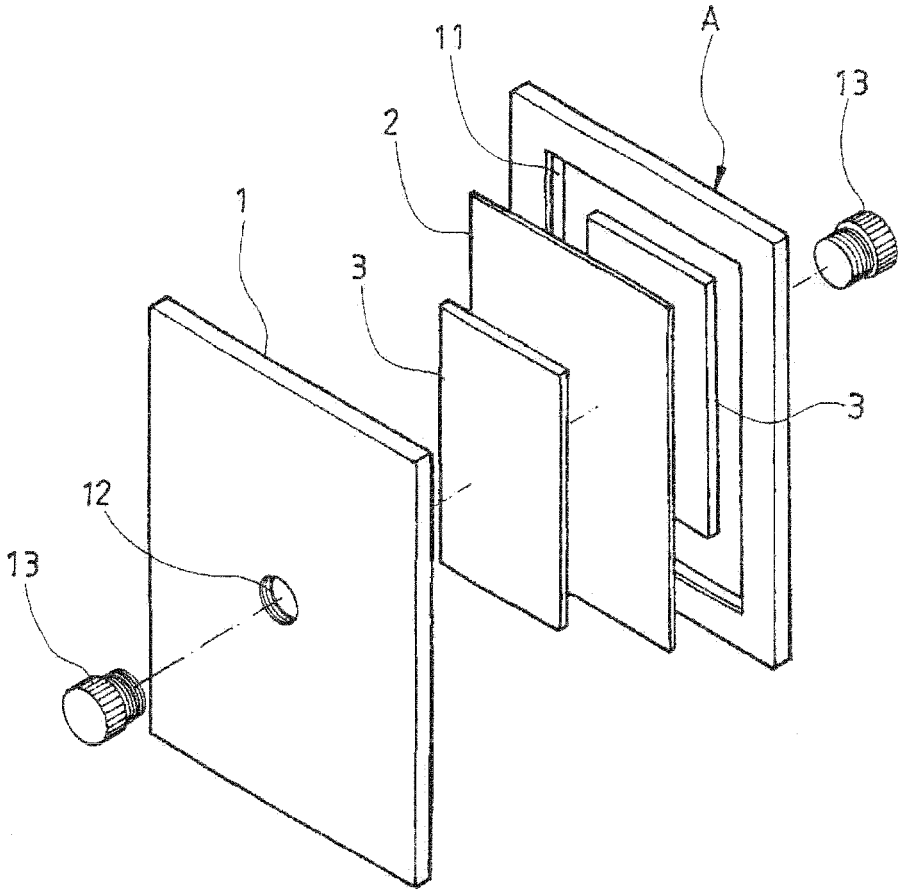
FIG. 4 is an exploded perspective view of the present invention with the use of the rotating member.
Figure 5:
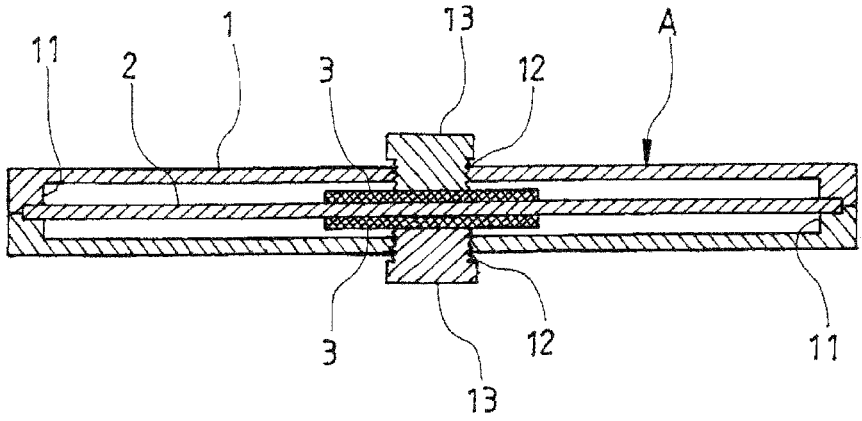
FIG. 5 is a sectional view of the present invention with the use of the rotating member.

FIGS. 4 and 5 show an exploded perspective view and a sectional view of the present invention with the use of a rotating member respectively. As shown in the figures, a threaded hole 12 is respectively provided at front and rear sides of the positioning frame 1 corresponding to a central position of the flexible unit, and a rotating member 13 is fastened into the threaded hole 12; wherein the rotating member 13 can be a screw bolt.

Once the rotating member 13 is fastened into the threaded hole 12, the flexible unit 3 is then being clamped between the bottom of said rotating member 13 and said acoustic generator 2. In this embodiment, the flexible unit is a silicon board.

According to the abovementioned structural combination, the reverse-phase modulating structure of the piezoelectric ceramic speaker is constructed. By moving the rotating members 13 in an upward or an downward movement along the threaded holes 12, the acoustic generator 2 is compressed or released correspondingly via the flexible unit 3 to achieve pressure adjustments on the acoustic generator 2 and such that the in-phase movement of the acoustic generator 2 is modulated, the phase conflict of the acoustic generator 2 is reduced, the sound quality distortion is prevented and such that the high quality of sound of the ceramic speaker A can be enhanced or realized. During an actual practice or operation, the flexible unit 3 can be relatively compressed or relaxed via the rotation of the rotating member 13 to move upward or downward. The adjustment of the pressure magnitude is based on the property tolerance of the acoustic generator 2 such that when the rotating member 13 moves downward, the flexible unit 3 is compressed and the acoustic generator 2 is therefore being exerted with a greater compression force thereon; whereas, on the contrary, when the rotating member 13 moves upward, the flexible unit 3 is relaxed and the acoustic is therefore subject to a smaller compression force thereon. As a result, the pressure adjustments on the acoustic generator 2 can be achieved, and the in-phase movement of the acoustic generator 2 is modulated, the phase conflict of the acoustic generator 2 is reduced, the sound quality distortion is prevented and such that the high quality of sound of the ceramic speaker A can be enhanced or realized.

Figure 6:
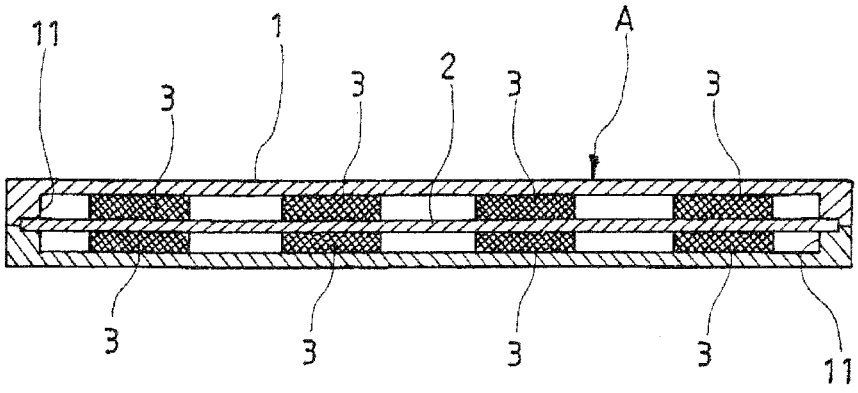
FIG. 6 is a sectional view of a third embodiment of the flexible unit of the present invention.

FIG. 6 shows a sectional view of a third embodiment of the flexible unit of the present invention. As shown in the figure, the flexible unit 3 can also be configured to be a multiple or plurality of units in addition to the abovementioned one such unit. Again, as shown in the figure, four flexible units 3 can be clamped between the acoustic generator and the positioning frame 1 and at the front and rear sides thereof based on design needs and requirements in order to achieve different levels of pressure exerted onto the acoustic generator 2.

During an actual practice or operation of the present invention, the positioning frame 1 having the acoustic generator 2 installed therein can be assembled into a box of a suitable size to form a sound box provided for electronic devices and their connections thereto. Electronic devices, including such as iPad, iPhone, laptop computers, can then be connected to the sound box during their uses and to produce audio sounds amplified by the acoustic generator 2 receiving sound signals from the electronic devices. In addition, via the pressure adjustments on the acoustic generator 2 by the flexible units 3, the in-phase movement of the acoustic generator 2 is modulated, the phase conflict of the acoustic generator 2 is reduced, the sound quality distortion is prevented and such that the high quality of sound of the ceramic speaker A can be enhanced or realized.

What is claimed is:

1. A reverse-phase modulating structure of a piezoelectric ceramic speaker, comprising:

a positioning frame;

an acoustic generator provided in an inner edge of said positioning frame;

two flexible units provided between said positioning frame and said acoustic generator, the two flexible units being respectively set on and in physical engagement with opposite sides of the acoustic generator so as to exert pressures on the opposite sides of the acoustic generator; and wherein an in-phase movement of said acoustic generator is modulated by the pressures exerted on said acoustic generator by said two flexible units in order to reduce a phase conflict of said ceramic speaker, to prevent sound quality distortion and such that high quality of sound of said ceramic speaker is enhanced and realized; and wherein holes are respectively formed in front and rear sides of said positioning frame corresponding in position to said two flexible units and rotating members are respectively fit in said holes to press said flexible units against said acoustic generator such that said rotating members are movable along said holes to adjust the pressures applied by said flexible units to said acoustic generator.

2. The reverse-phase modulating structure of a piezoelectric ceramic speaker according to claim 1, wherein said acoustic generator comprises a plurality of ceramic layers stacked onto one another to form a ceramic slat.

3. The reverse-phase modulating structure of a piezoelectric ceramic speaker according to claim 2, wherein said acoustic generator comprises said ceramic slat and a sound board attached to said ceramic slat.

4. The reverse-phase modulating structure of a piezoelectric ceramic speaker according to claim 1, wherein said flexible units each comprise a silicon board.

5. The reverse-phase modulating structure of a piezoelectric ceramic speaker according to claim 1, wherein said flexible units each comprise a sponge.

6. The reverse-phase modulating structure of a piezoelectric ceramic speaker according to claim 1, wherein said flexible units each comprise a pressure spring.

7. The reverse-phase modulating structure of a piezoelectric ceramic speaker according to claim 1, wherein said flexible units each comprise a tension spring.

8. The reverse-phase modulating structure of a piezoelectric ceramic speaker according to claim 1, wherein said rotating members each comprise a screw bolt and said holes formed in the front and rear sides of said positioning frame are threaded holes that respectively receive the rotating members to screw therein.

* * * * *